US012110757B2

(12) United States Patent
Eriksen

(10) Patent No.: US 12,110,757 B2
(45) Date of Patent: Oct. 8, 2024

(54) PACKER ARRANGEMENT FOR SEALINGLY GUIDING A DRILLSTRING THERETHROUGH

(71) Applicant: ELECTRICAL SUBSEA & DRILLING AS, Straume (NO)

(72) Inventor: Egil Eriksen, Al (NO)

(73) Assignee: ELECTRICAL SUBSEA & DRILLING AS, Straume (NO)

( * ) Notice: Subject to any disclaimer, the term of this patent is extended or adjusted under 35 U.S.C. 154(b) by 0 days.

(21) Appl. No.: 18/037,325

(22) PCT Filed: Nov. 17, 2021

(86) PCT No.: PCT/NO2021/050240
§ 371 (c)(1),
(2) Date: May 17, 2023

(87) PCT Pub. No.: WO2022/108455
PCT Pub. Date: May 27, 2022

(65) Prior Publication Data

US 2023/0417119 A1 Dec. 28, 2023

(30) Foreign Application Priority Data

Nov. 21, 2020 (NO) ..... 20201277
Nov. 16, 2021 (NO) ..... 20211367

(51) Int. Cl.
*E21B 33/128* (2006.01)
*E21B 17/10* (2006.01)

(52) U.S. Cl.
CPC ..... *E21B 33/128* (2013.01); *E21B 17/1014* (2013.01); *E21B 33/1285* (2013.01)

(58) Field of Classification Search
CPC ..... E21B 33/128; E21B 17/1014; E21B 33/1285; E21B 21/08; E21B 33/08
See application file for complete search history.

(56) References Cited

U.S. PATENT DOCUMENTS 491,029 A * 1/1893 Toucey ..... E21B 33/08 277/513
3,614,111 A * 10/1971 Regan ..... F16K 7/075 251/1.2

(Continued)

FOREIGN PATENT DOCUMENTS

NO 341994 B1 3/2018
WO WO 2015/184275 A1 12/2015
WO WO 2014/006149 A2 3/2018

*Primary Examiner* — Jonathan Malikasim
(74) *Attorney, Agent, or Firm* — Norman B. Thot

(57) ABSTRACT

A packer arrangement for a sealed passage of a drillstring therethrough. The drillstring has geometric differences between passing drill pipes and joint couplings. The packer arrangement includes a packer holder which forms a housing with an axially through-going center passage which has a flexible packer sleeve arranged in a portion thereof, an external annulus which encloses the packer holder, an internal annulus, and two actuators which apply an axial tensile force to the flexible packer sleeve. The flexible packer sleeve has a center portion and two end terminations which are axially displaceable in the packer holder. The internal annulus is delimited by the center portion of the flexible packer sleeve and by the packer holder. The internal annulus is in a fluid communication with the external annulus. Each of the two end terminations is coupled to one of the two actuators, respectively.

6 Claims, 3 Drawing Sheets

(56) References Cited

U.S. PATENT DOCUMENTS

| | | | | |
|---|---|---|---|---|
| 3,955,822 | A * | 5/1976 | Irby | F16J 15/004 277/513 |
| 7,779,903 | B2 * | 8/2010 | Bailey | F16J 15/3224 277/333 |
| 7,926,560 | B2 * | 4/2011 | Bailey | E21B 33/085 277/333 |
| 9,212,532 | B2 * | 12/2015 | Leuchtenberg | E21B 33/085 |
| 9,328,575 | B2 * | 5/2016 | Feasey | E21B 21/082 |
| 9,500,053 | B2 * | 11/2016 | Leuchtenberg | E21B 21/08 |
| 9,605,504 | B2 * | 3/2017 | Leuchtenberg | E21B 21/08 |
| 9,932,786 | B2 * | 4/2018 | Chambers | E21B 19/24 |
| 10,012,044 | B2 * | 7/2018 | Leba | E21B 17/085 |
| 10,077,604 | B2 * | 9/2018 | Chambers | E21B 33/03 |
| 2005/0241833 | A1 | 11/2005 | Bailey et al. | |
| 2015/0315845 | A1 | 11/2015 | Chambers et al. | |
| 2015/0315874 | A1 | 11/2015 | Chambers | |
| 2015/0345236 | A1 | 12/2015 | Chambers et al. | |
| 2018/0355683 | A1 | 12/2018 | Eriksen | |
| 2022/0381105 | A1 * | 12/2022 | Wilson | E21B 21/08 |

* cited by examiner

PACKER ARRANGEMENT FOR SEALINGLY GUIDING A DRILLSTRING THERETHROUGH

CROSS REFERENCE TO PRIOR APPLICATIONS

This application is a U.S. National Phase application under 35 U.S.C. § 371 of International Application No. PCT/NO2021/050240, filed on Nov. 17, 2021 and which claims benefit to Norwegian Patent Application No. 20201277, filed on Nov. 21, 2020, and to Norwegian Patent Application No. 20211367, filed on Nov. 16, 2021. The International Application was published in English on May 27, 2022 as WO 2022/108455 A1 under PCT Article 21(2).

FIELD

The present invention relates to a packer arrangement for sealingly guiding a drillstring therethrough that has geometrical differences between passing drill pipes and joint couplings, more specifically in that a packer holder forms a housing with an axially through-going center passage that in a portion comprises a flexible packer sleeve, and an internal annulus is delimited by a center portion of the packer sleeve and the packer holder and is in fluid communication with an external annulus that encloses the packer holder, and the packer arrangement comprises a device for length compensation and unloading of a packer sleeve that encloses the drillstring.

The present invention more specifically relates to a packer sleeve that typically forms part of a rotatable sealing device in a packer arrangement, the packer sleeve being arranged to absorb geometrical differences between passing drill pipes and pipe couplings in a drillstring during drilling in the petroleum industry, for example, in Managed Pressure Drilling (MPD) and Dual Gradient Drilling (DGD). The packer sleeve can also be used where an enclosure about a drillstring is desired, without requirements for the sealing device to be rotatable, typically when screwing together new drill pipe lengths during drilling. The packer arrangement may be mounted on or at a surface installation, form part of a riser between the surface installation and a blow-out preventer (BOP) on a wellhead, or be mounted on top of a BOP when drilling in open sea. The device should seal against the drillstring during drilling and cementing, and typically direct returned drilling fluid from a well to a side outlet below the packer arrangement to a pump and a valve arrangement that can be arranged in differently depending on the drilling technique used in the relevant case.

BACKGROUND

A packer sleeve of this type is typically molded in a polyurethane material, and can be reinforced with embedded fiber ropes that are disposed in the longitudinal direction of the packer sleeve and are anchored in embedded steel rings in end terminations in the packer sleeve.

The packer sleeve should seal against a differential pressure from the bottom side or the top side depending on the pressure conditions during the operation. It should at the same time withstand an axial friction load from passing drill pipes while the sleeve clamps around the pipe. The friction load depends on the length of a sealing center portion in the packer sleeve, the external actuation pressure of the packer sleeve, and the friction between the packer sleeve and the drill pipe. The end terminations of the packer sleeve, which should be able to withstand combinations of stretching and bowing of the packer sleeve during actuation of the packer arrangement, are the most important mechanical restriction in relation to the maximum differential pressure and the friction load with which the sleeve can be operated.

The length of the packer sleeve should, for example, be minimized and thereby also the contact area against the drillstring to reduce the friction load and concurrently restrict the build height of the packer arrangement as well as minimizing an annulus volume that surrounds the packer sleeve. The packer sleeve should also, for example, be able to seal around several drill pipe and coupling dimensions. Regard must, however, be given to conditions like the flexibility of the packer sleeve, buckling, and sealing area against the drillstring, and this sets restrictions for minimizing the build length of the packer arrangement when it comes to achieving the best possible function.

A solution described in NO 341994 B1 consists of, among other things, a flexible packer sleeve that is arranged to abut in a sealing manner against a drillstring with an external pressure from a fluid in a volume-compensated annulus, in an external housing, which can be part of a drilling riser. When the packer sleeve is actuated, it rotates with the drillstring, while rotational sealing and support of the sealing elements are effected by packer gliding rings at each end of the device.

US 2005/0241833 A1 describes a packer arrangement for use in a rotating sealing arrangement. A thick-walled packer sleeve is at a first end portion anchored in a fastening ring, typically in that a sleeve-shaped extension of the fastening ring extends axially into the end portion of the packer sleeve. A second end portion of the packer sleeve is connected to a piston ring. The packer sleeve is pressed in a sealing manner against a passing pipe body by a first hydraulic pressure pressing the piston ring towards the fastening ring, or by a second hydraulic pressure being applied to the external side surface of the packer sleeve.

SUMMARY

An aspect of the present invention is to remedy or reduce at least one of the disadvantages of the prior art, and to increase the ability of a packer sleeve to withstand differential pressure as well as to reduce and withstand a friction load from a drillstring.

In an embodiment, the present invention provides a packer arrangement for a sealed passage of a drillstring therethrough. The drillstring has geometric differences between passing drill pipes and joint couplings. The packer arrangement includes a packer holder which is configured to form a housing with an axially through-going center passage which comprises a flexible packer sleeve arranged in a portion thereof, an external annulus which is configured to enclose the packer holder, an internal annulus, and two actuators which are configured to apply an axial tensile force to the flexible packer sleeve. The flexible packer sleeve comprises a center portion and two end terminations which are configured to be axially displaceable in the packer holder. The internal annulus is delimited by the center portion of the flexible packer sleeve and by the packer holder. The internal annulus is in a fluid communication with the external annulus. Each of the two end terminations is coupled to one of the two actuators, respectively.

BRIEF DESCRIPTION OF THE DRAWINGS

The present invention is described in greater detail below on the basis of embodiments and of the drawings in which.

DETAILED DESCRIPTION

Figure 1:
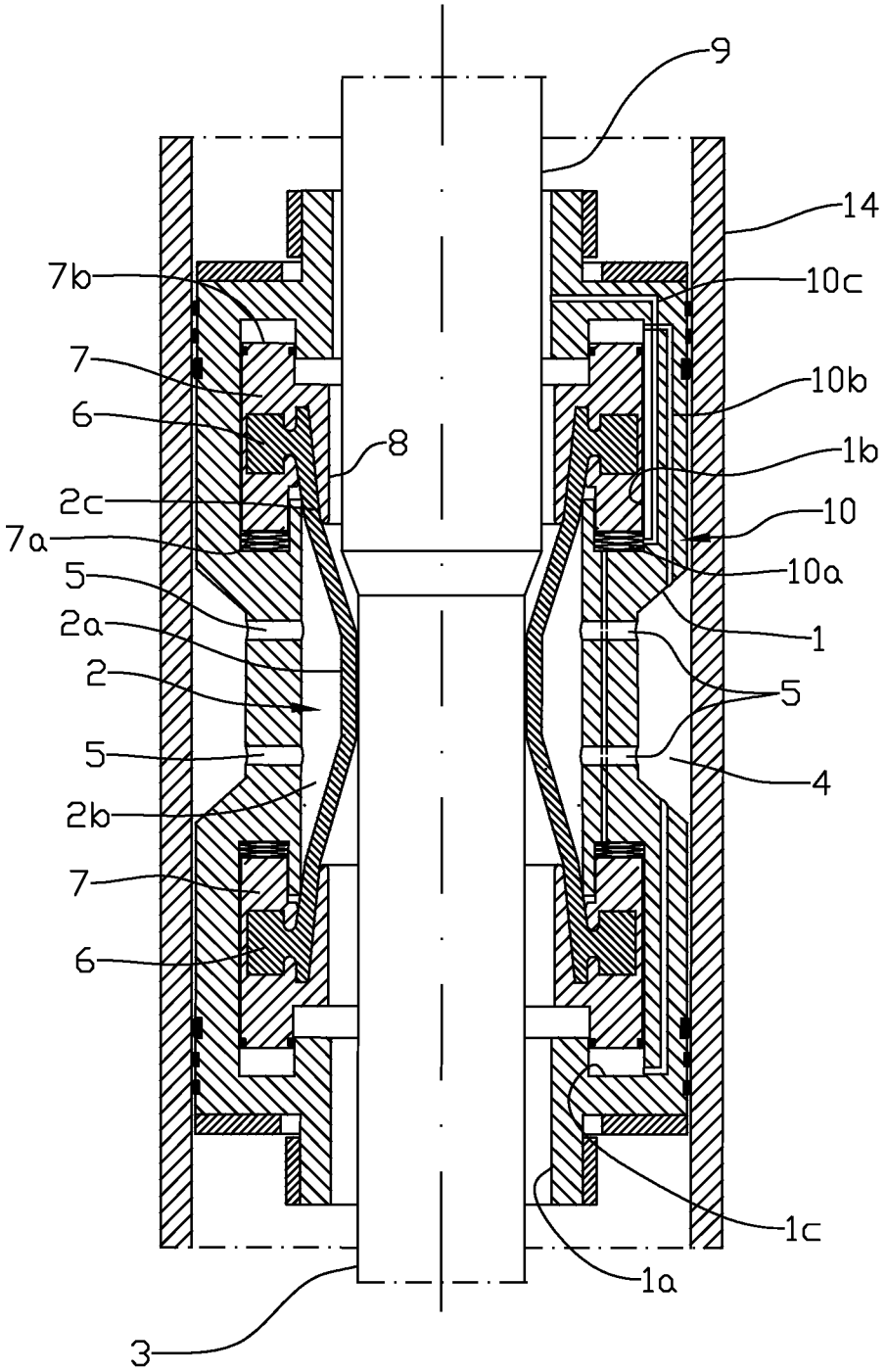
FIG. 1 shows in an axial section of a first embodiment of a packer arrangement according to the present invention, wherein a passive, spring-activated actuator arrangement applies a tensile load to a packer sleeve.

The present invention provides a packer arrangement, wherein a relatively thin-walled, flexible packer sleeve and a packer holder delimit an internal annulus that can be pressurized. End portions in the packer sleeve form end terminations that each comprise a ring that is axially displaceable in the packer holder via one or more actuators, to thereby hold a non-actuated packer sleeve extended as well as to allow the axial extension of the packer sleeve to be reduced when a center portion of a pressure-activated packer sleeve is pressed radially against a passing drill pipe.

The actuators may be arranged as yielding, non-controlled arrangements, typically as springable devices, or as controlled arrangements, typically as hydraulic arrangements affected by a controlled, applied hydraulic pressure.

The present invention more specifically relates to a packer arrangement for sealing a passage of a drillstring therethrough that has geometric differences between passing drill pipes and joint couplings, wherein:

- a packer holder forms a housing with an axially throughgoing center passage that in a portion comprises a flexible packer sleeve; and
- an internal annulus which is delimited by a center portion of the packer sleeve and the packer holder, and which is in fluid communication with an external annulus that encloses the packer holder, characterized in that,

- the packer sleeve comprises end terminations that are axially displaceable in the packer holder, wherein,
- each end termination is coupled to an actuator arranged to be able to apply an axial tensile force to the packer sleeve.

Each actuator may be provided with springs arranged to push the end terminations away from each other. An effect thereof is that the packer arrangement can be provided with simple and cost-effective actuators.

Each actuator may alternatively be formed as a hydraulic piston ring which is arranged to push the end terminations away from each other. An effect thereof is an improved control of the movements of the actuators.

The packer holder may be provided with stabilizer springs which are arranged to cushion the impact of the piston rings against end stops in the packer holder. An effect thereof is a gentler movement of the actuators.

Each ring may be provided with a support collar that is arranged to restrict deflection of a transition zone between each end termination and the center portion of the packer. An effect thereof is an increase in the service life of the packer sleeve.

The supporting collars that are arranged to restrict a bowing/deflection of a transition zone between each end termination and the center portion of the packer sleeve may be integrated in the packer holder. An effect thereof is a simplified design of the rings.

Examples of preferred embodiments of the present invention are described below under reference to the attached drawings. All reference numerals thereby refer to the position shown in the drawings. The same or corresponding elements are indicated with the same reference number(s) in the drawings. For the sake of clarity, some elements may not have reference numbers in some of the drawings.

A person skilled in the art will understand that the drawings are only principle drawings. The relative ratios between individual elements may also be distorted.

In the drawings, the reference number 1 indicates a packer holder that forms a housing that encloses a relatively thin-walled, flexible packer sleeve 2. The packer sleeve 2 is arranged to fit in a sealing manner against a portion of a drill pipe 3 that is inserted through a center passage 1*a* in the packer holder 1. The sealing function of the packer sleeve 2 against the drill pipe 3 is activated through external pressurization from an external annulus 4 that encloses the packer holder 1 and is delimited by a riser 14 (see FIG. 1). An internal annulus 2*b* that is delimited by the packer sleeve 2 and the packer holder 1 communicates with the external annulus 4 that encloses the packer holder 1 through openings 5 in the packer holder 1. The packer sleeve 2 comprises end terminations 6 that are fastened to a respective ring 7 axially displaceably supported in the packer holder 1.

As a joint coupling 9 between two drill pipes 3 passes through the packer sleeve 2, the packer sleeve 2 expands radially out towards the packer holder 1 and displaces a liquid volume from the external annulus 4 to a pressure compensator (not shown). Deformation, for example, a buckling of the expanded packer sleeve 2, is prevented by the rings 7 being pushed in their respective axial direction and the packer sleeve 2 being extended.

When the packer sleeve 2 is not pressure-actuated to enclose in a sealing manner about a drill pipe 3, it is advantageous if the packer sleeve 2 contacts the drill pipe 3 as little as possible.

Figure 2:
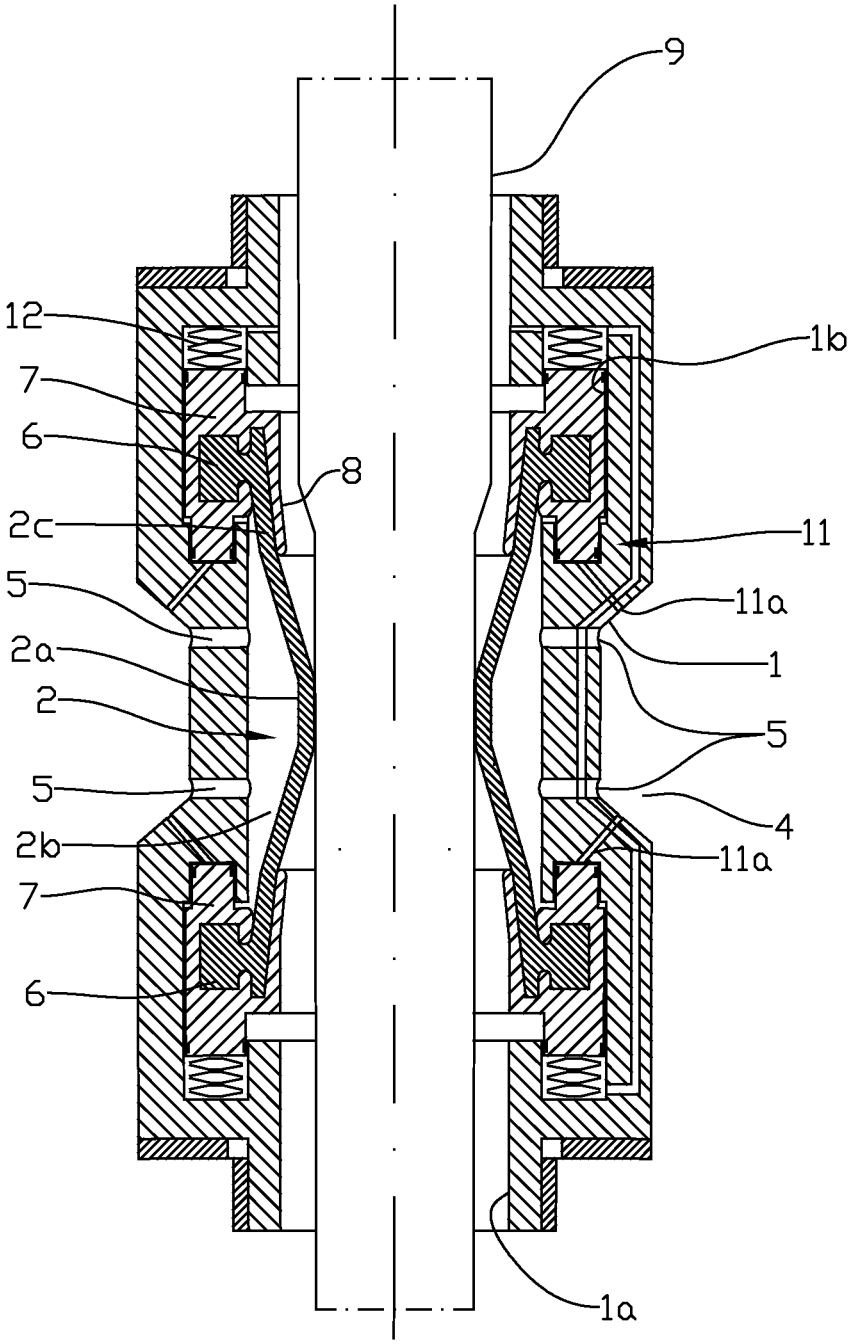
FIG. 2 shows an axial section of a second embodiment of the packer arrangement according to the present invention, where the actuator arrangement can be used in riser applications, where hydrostatic pressure from a liquid column in the riser provides that the actuator arrangement holds the packer sleeve extended when pressure has not been applied to it from the outside.
Figure 3:
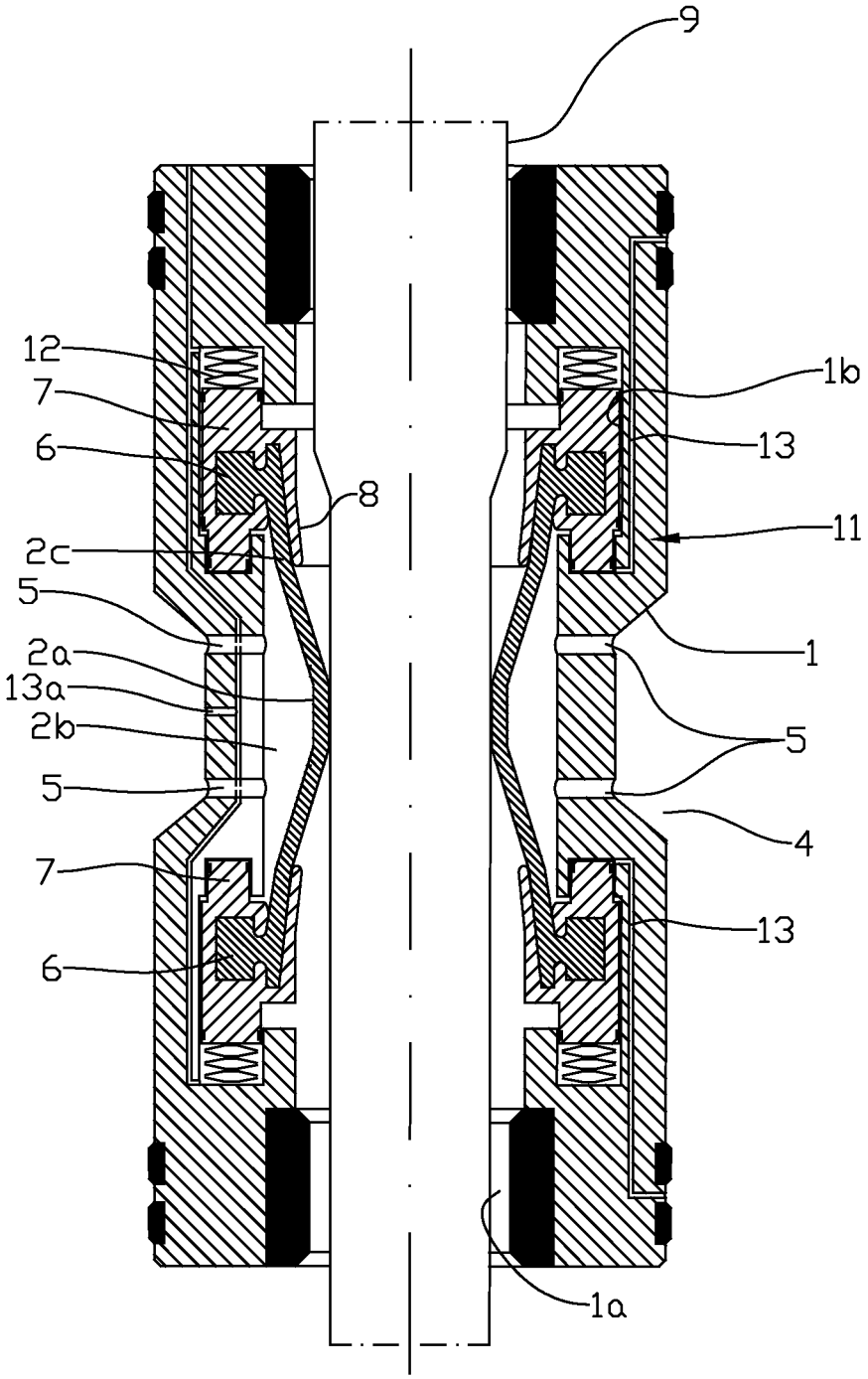
FIG. 3 shows an axial section of a third embodiment of the packer arrangement according to the present invention, which is intended for use where no requirement for rotation of the packer arrangement exists, wherein a controlled hydraulically activated actuator arrangement provides length compensation of the packer sleeve.

The packer sleeve 2 can be held extended by passive or active actuators, i.e., as yielding, non-controlled arrangements, typically as springable devices, or as controlled arrangements, typically as hydraulic arrangements affected by a controlled, applied hydraulic pressure, or a combination thereof, as shown in FIGS. 1-3 and as explained below.

FIG. 1 shows a passive, non-controlled, spring-actuated actuator arrangement 10 for length compensation of the packer sleeve 2. When the packer sleeve 2 is actuated by an external pressure from the external annulus 4 between the packer holder 1 and the riser 14, and a center portion 2*a* is pressed against a portion of a drill pipe 3, an axial stretch in the packer sleeve 2 contributes to pulling the rings 7 in an axial direction towards each other while springs 10*a* that abut in a supporting manner between the rings 7 and an end surface in an annular recess 1*b* in the packer holder 1, are compressed. As the packer sleeve 2 is expanded radially by a passing joint coupling 9, the deformation of the packer sleeve 2 is absorbed by the rings 7, via the spring-actuated actuator arrangement 10, being pushed away from each other and stretching the packer sleeve 2. The force that acts on the rings 7 is a combination of a spring force from the compressed springs 10*a* and a rigidity of the packer sleeve 2. When the packer sleeve 2 does not have an external pressure applied to it to seal against the drill pipe 3, the packer sleeve 2 is stretched in the longitudinal direction of the springs 10*a*, and the packer sleeve 2 is held open in the packer holder 1, i.e., there is clearance between the packer sleeve 2 and the drill pipe 3. A piston area 7*b* on the opposite side of the springs 10*a* will be exposed to the pressure in the external annulus 4 via channels 10*b*. Ventilation channels 10*c* provide that the volume around the springs 10*a* is ventilated. The piston area 7*b* is adapted to the capacity of the springs 10*a*.

FIG. 2 shows a balanced solution, where an annular recess 1*b* that is delimited by end surfaces 7*a* on the rings 7 is in a fluid communication with the external annulus 4 via hydraulic ventilation channels 11*a* in the packer holder 1. The hydraulic ventilation channels 11*a* provide that the volume around the stabilizer springs 12 is ventilated to a low-pressure area over the packer sleeve 2.

Stabilizer springs 12 abut in a supporting manner between the opposite side of the rings 7 and an end stopper surface 1*c* in the packer holder 1. As the packer sleeve 2 is expanded radially by a passing joint coupling 9, the rigidity of the packer sleeve 2 and an applied hydraulic pressure from the external annulus 4 will push the rings 7 away from each other, while the packer sleeve 2 is stretched in the longitudinal direction.

FIGS. 1-3 show that the rings 7 are provided with support collars 8 that restrict the deflection of the pressurized packer sleeve 2 in a transition zone 2*c* between the end terminations 6 and the center portion 2*a* of the packer sleeve 2 by pressure-actuation of the packer sleeve 2 from the external annulus 4. The solution is particularly appropriate for a use where no requirement exists for the packer holder 1 to be able to rotate.

During Managed Pressure Drilling (MPD) from a surface installation, the packer arrangement according to the present invention will typically be mounted internally in a marine riser 200-500 meters below the drill deck of the surface installation, provided that the actual ocean depth is sufficient. Passive length compensation of the packer sleeve 2 is especially appropriate in a drilling riser 14 where hydrostatic pressure from the liquid column in the drilling riser 14 will expand the packer sleeve 2 in a radial direction when the packer sleeve 2 is not activated by pressure from the external annulus 4. One also avoids challenges related to hydraulic distribution channels and coupling of hydraulics from the outside for active control of length compensation of the packer sleeve 2.

FIG. 3 shows a solution with controlled length compensation of the packer sleeve 2, where an end surface on each ring 7 is actively pressurized via channels 13 in the packer holder 1 via a control system (not shown). Stretching of the packer sleeve 2 is coordinated with bleeding of the pressure in the external annulus 4 via the control system. The stabilizer springs 12 are compressed, and liquid is evacuated on the spring side via channels 13*a*.

Necessary seals are not described, but are known to a skilled person.

It should be noted that all embodiments mentioned above illustrate the present invention, but do not delimit it, and that experts on the subject will be able to design many alternative embodiments without deviating from the scope of the appended claims.

The use of the verb "to comprise" and its different forms does not exclude the presence of elements or steps not mentioned in the claims. The indefinite articles "a" or "an" before an element do not exclude the presence of more such elements.

LIST OF REFERENCE NUMERALS

1 Packer holder
1*a* Center passage
1*b* Annular recess
1*c* Stopper surface
2 Packer sleeve
2*a* Center portion
2*b* Internal annulus
2*c* Transition zone
3 Drill pipe
4 External annulus
5 Openings
6 End terminations
7 Ring
7*a* End surface
7*b* Piston area
8 Support collar
9 Joint coupling
10 Spring-actuated actuator arrangement
10*a* Spring
10*b* Channel
10*c* Ventilation channel
11 Spring-actuated actuator arrangement
11*a* Hydraulic ventilation channel
12 Stabilizer springs
13 Channel
13*a* Channel
14 Riser/Drilling riser

What is claimed is:

1. A packer arrangement for a sealed passage of a drillstring therethrough, the drillstring having geometric differences between passing drill pipes and joint couplings, the packer arrangement comprising:

a packer holder which is configured to form a housing with an axially through-going center passage which comprises a flexible packer sleeve arranged in a portion thereof, the flexible packer sleeve comprising a center portion and two end terminations which are configured to be axially displaceable in the packer holder;

an external annulus which is configured to enclose the packer holder;

an internal annulus which is delimited by the center portion of the flexible packer sleeve and by the packer holder, the internal annulus being in a fluid communication with the external annulus; and two actuators which are configured to apply an axial tensile force to the flexible packer sleeve, wherein, each of the two end terminations is coupled to one of the two actuators, respectively.

2. The packer arrangement as recited in claim 1, wherein each of the two actuators comprises springs which are configured to push the two end terminations away from each other.

3. The packer arrangement as recited in claim 1, wherein each of the two actuators is formed as a hydraulic piston ring which is configured to push the two end terminations away from each other.

4. The packer arrangement as recited in claim 3, wherein, the packer holder further comprises two end stops each of which have a respective end stopper surface, and stabilizer springs, one of the stabilizer springs is correspondingly arranged to abut between one end stopper surface in the packer holder and a side of one of the hydraulic piston rings that is opposite to a corresponding one of the two actuators, and each of the stabilizer springs is configured to cushion an impact of the corresponding hydraulic piston ring against the corresponding one of the two end stops.

5. The packer arrangement as recited in claim 3, wherein, a transition zone exists between each of the two end terminations and the center portion of the flexible packer sleeve, and each hydraulic piston ring comprises a support collar which is configured to restrict a deflection of the transition zone.

6. The packer arrangement as recited in claim 5, wherein each support collar is integrated in the packer holder.

* * * * *